US009752564B2

(12) United States Patent
Arceno et al.

(10) Patent No.: US 9,752,564 B2
(45) Date of Patent: Sep. 5, 2017

(54) COMPRESSOR WITH AN ACOUSTIC ATTENUATOR DEVICE

(71) Applicant: Whirlpool S.A., São Paulo - SP (BR)

(72) Inventors: Eduardo Arceno, Joinville (BR); Bruno Eduardo Da Silva, Joinville (BR)

(73) Assignee: Whirlpool S.A., Sao Paulo, SP (BR)

( * ) Notice: Subject to any disclaimer, the term of this patent is extended or adjusted under 35 U.S.C. 154(b) by 0 days.

(21) Appl. No.: 14/908,707

(22) PCT Filed: Jul. 17, 2014

(86) PCT No.: PCT/BR2014/000243
§ 371 (c)(1),
(2) Date: Jan. 29, 2016

(87) PCT Pub. No.: WO2015/013788
PCT Pub. Date: Feb. 5, 2015

(65) Prior Publication Data

US 2016/0186735 A1 Jun. 30, 2016

(30) Foreign Application Priority Data

Jul. 30, 2013 (BR) ..... 102013019311

(51) Int. Cl.
*F01N 1/08* (2006.01)
*F04B 39/00* (2006.01)
*F04B 39/06* (2006.01)

(52) U.S. Cl.
CPC ..... *F04B 39/0055* (2013.01); *F04B 39/0061* (2013.01); *F04B 39/0072* (2013.01); *F04B 39/06* (2013.01)

(58) Field of Classification Search
CPC ..... F04B 39/0055; F04B 39/0061
(Continued)

(56) References Cited

U.S. PATENT DOCUMENTS 5,201,640 A 4/1993 Heinzelmann et al.
5,971,720 A 10/1999 Fagotti et al.
(Continued)

FOREIGN PATENT DOCUMENTS

WO 02101239 A1 12/2002
WO 2013086592 A1 6/2013

OTHER PUBLICATIONS

International Search Report and Written Opinion of counterpart International Application No. PCT/BR2014/000243 dated Jan. 15, 2015.

*Primary Examiner* — Forrest M Phillips
(74) *Attorney, Agent, or Firm* — Harrington & Smith

(57) ABSTRACT

The present invention refers to a compressor with an acoustic attenuator device, preferably those used in refrigeration systems, in general. More specifically, the present invention refers to an acoustic attenuator device comprising technical, structural, and functional features capable of simplifying the method of fabricating these parts and increasing acoustic attenuation levels of hermetic compressors, in general. In this sense, the attenuator device of the present invention comprises a hollow body closed by a cover to form a structure having at least one inlet hole and an outlet hole, wherein there is provided between said hollow body and said cover at least one intermediate body dividing said structure into at least two acoustic chambers (A, A'), and is formed by a platform provided with a connecting channel, which is in fluid communication between said acoustic chambers (A, A') and further surrounds an outlet channel, which is interconnected with said outlet hollow disposed on said cover.

13 Claims, 4 Drawing Sheets

(58) Field of Classification Search
USPC ..... 181/272; 417/312
See application file for complete search history.

(56) References Cited

U.S. PATENT DOCUMENTS

| | | | | |
|---|---|---|---|---|
| 6,149,402 | A * | 11/2000 | Kim | F04B 39/0055 181/403 |
| 6,506,028 | B2 | 1/2003 | Silveira et al. | |
| 7,147,082 | B2 * | 12/2006 | Lilie | F04B 39/0066 181/229 |
| 7,922,460 | B2 * | 4/2011 | Nagao | F04B 39/0061 417/312 |
| 2004/0120832 | A1 * | 6/2004 | Nishihara | F04B 39/023 417/312 |
| 2004/0179955 | A1 | 9/2004 | Lee | |
| 2005/0031461 | A1 | 2/2005 | Lilie et al. | |
| 2006/0039803 | A1 * | 2/2006 | Nakano | F04B 39/0055 417/312 |
| 2007/0212234 | A1 * | 9/2007 | Murata | F04B 39/0072 417/312 |
| 2008/0247886 | A1 * | 10/2008 | Inagaki | F04B 39/0061 417/312 |
| 2009/0028726 | A1 * | 1/2009 | Park | F04B 39/0072 417/312 |
| 2009/0257892 | A1 * | 10/2009 | Svendsen | F04B 39/0061 417/312 |
| 2011/0014065 | A1 * | 1/2011 | Park | F04B 39/0061 417/312 |

* cited by examiner

COMPRESSOR WITH AN ACOUSTIC ATTENUATOR DEVICE

CROSS-REFERENCE TO RELATED APPLICATIONS

This application is a U.S. National Stage of International Patent Application No. PCT/BR2014/000243, filed on Jul. 17, 2014, which claims priority to Brazilian Patent Application No: BR1020130193119, filed on Jul. 30, 2013. The disclosure of each of these applications are incorporated herein by reference in their entirety.

FIELD OF INVENTION

The present invention refers to a compressor with an acoustic attenuator device commonly used in refrigeration systems in general. More particularly, the present invention refers to an acoustic attenuator comprising technical, structural and functional features capable of simplifying the manufacture process of these parts as well as increasing the acoustic attenuation levels of said hermetic compressors, in general.

BACKGROUND OF THE INVENTION

According to the state of the art, and as it is generally known by those skilled in the art, most hermetic compressors applied to refrigeration systems are provided with a device disposed inside the compressor housing, and, more specifically in the suction line and/or discharge line, which purpose is, in addition to conveying refrigerant gas, to reduce the noise caused by strokes and vibrations of suction valve and compression chamber, It also aims at thermally insulating refrigerant gas.

These acoustic attenuator devices, also known as "muffler", may have different nomenclatures when defining their installation position relative to a compression unit. For example, the terminology suction filter or suction muffler is very common when an attenuator device is disposed in the suction line so as to conduct the refrigerant gas from the strainer to the suction valve. When said attenuator device is disposed at the compression unit, nomenclatures of expansion chamber or expansion muffler types are used.

Irrespective of the installation position, said attenuator devices known from the state of the art present relatively complex configurations and are difficult to manufacture and mount mainly because they comprise small structures and require high levels of accuracy and finishing to ensure the direction of gases, acoustic muffling and in some cases thermal insulation of these gases.

More specifically, it is observed that attenuator devices known from the state of the art comprise a hollow body within which chamber and ducts are disposed to conduct gases to and from the compression unit. As can be appreciated by a person skilled in the art, this displacement of gases is generated by pulsation of the compression chamber which, consequently, generates noises, which can be attenuated according to the specificities of these chambers and ducts through which the gases pass.

A drawback of these already known devices resides in the structural aspects for assembling these chambers and inner ducts to conduct gases. More particularly, it is noted that the present state of the art comprises chambers and ducts formed by several parts and walls which are engaged with each other to obtain an extension of pathways for gas circulation inside an attenuator device. However, considering the number of inter-related parts, it is noted that there is a great number of interaction which causes gas leakage, that is, as it is known by a person skilled in the art the greater the number of parts connected therebetween the higher is the risk of leakage, thereby directly affecting the acoustic attenuation levels, mainly operation conditions of the compressor.

Furthermore, by virtue of the features of such chambers and ducts of the state-of-the-art attenuation devices, it is verified that there is a certain limitation concerning geometrical configuration of these features since in order to obtain appropriate volume and pathway to reduce noise manufacturers use configurations which, in some cases, render the process relatively more complex and expensive.

Some examples of embodiments of attenuation devices for hermetical compressors, according the state-of-the-art knowledge, are disclosed in US2005/0031461, U.S. Pat. No. 5,201,640, U.S. Pat. No. 5,971,720 and U.S. Pat. No. 6,506,028. As can be noted, these documents basically present two huge drawbacks. The first lies in the seal level between the chambers and formed ducts, mainly because the seal, in these cases, is obtained only by virtue of interference of materials wherein this seal although being useful for many applications requires very precise and well-controlled geometries, thus compromising the production lines due to the complexity of tools and manufacture and assembling costs involved to obtain a minimal level of quality to guarantee suitable seal.

The documents US2004/179955 and U.S. Pat. No. 6,149,402 provide suction muffler for compressors in which a kind of resonance chamber is applied, said resonance chambers wherein only a small part of the refrigerant in operation may flow into; the objective of such chamber is to damp the noises, but they may affect the compressor efficiency.

Finally, the documents WO02101239, WO2013086592 and US2009257892 present suction mufflers with their peculiarities, but unable to solve the current prior art problems.

Other drawback presented by the attenuator devices known in the art concerning the configuration of inner ducts, which, in order to increase the gas conduction pathway, require more intermediate parts, thus increasing the amount of seals by simple interference of material, which will then result in more complex designs and higher manufacture and mounting costs.

Another drawback found in the state-of-the-art attenuator devices stems from the fact that their configurations do not allow one to modify the length of inner ducts, especially in the case of suction duct, which length is directly related to the actuation frequency of the suction valve. Thus, with regard to the attenuator devices of the state of the art, there is only one way of altering the length of the inner ducts which can be made by using two or more parts and, consequently, more complex and expensive designs will be required.

In view of the foregoing, one may see that the attenuator devices for hermetic compressors, according to the state of the art, present some limitations and drawbacks which have a direct impact on the attenuation level of noise, mainly because their configurations are rather complex and difficult to mount.

OBJECTS OF THE INVENTION

Firstly, it should be pointed out that the attenuator device of the present invention can be applied either to suction lines or to discharge lines of the compressors. Hence, for this reason, the description below will simply refer to an attenuator device, and as such it should be clear that such nomenclature shall be interpreted in a simple form, whereby any positions within the hermetic compressors are herein contemplated.

Thus, the object of the present invention is to provide an attenuator device to be applied to hermetic compressors commonly used in refrigeration systems, wherein it comprises technical, structural and functional features specifically developed to simplify the method of manufacturing said devices but mainly to improve the capacity of attenuating noises.

More preferably, the object of the present invention is to provide an attenuator device for hermetic compressors, which is capable of reducing and even eliminating eventual risks of gas leakage between chambers and ducts contained inside the attenuator device body to provide conditions suitable for the due circulation of refrigerant gases.

Additionally, an object of the present invention is to provide an attenuator device to be applied to hermetic compressors, which structural features permit to obtain a simple but highly efficient construction relative to the seal between the acoustic chambers, without impairing the conduction of gases between the chambers.

In summary, and in a more objective form, the object of the present invention is to provide an attenuator device for hermetic compressors, which technical and structural features allow for forming acoustic chambers and ducts to conduct refrigerant gases through an assembly containing a substantially reduced number of parts, and mainly containing suitable and safe sealing means.

SUMMARY OF THE INVENTION

By this way, in order to achieve the objects and technical features cited above, the present invention refers to an compressor with an acoustic attenuator device, wherein said device comprises a hollow body that is closed with a cover so as to form a structure having at least one inlet hole and one outlet hole. More particularly, at least one intermediate body capable of dividing said structure into at least two acoustic chambers is disposed between said hollow body and said cover, wherein said intermediate body is formed by a platform provided with at least one connecting channel which is in fluid communication between said acoustic chambers and also surrounds the outlet channel that is connected to the outlet hole, preferably disposed on said cover.

In accordance with the preferred embodiments of the present invention, said connecting channel and said outlet channel form a space sufficient to allow gases to pass between said acoustic chambers. More particularly, said connecting and outlet channels are concentrically disposed, but they may alternatively be disposed in an off-centered form, that is, said channel may or may not coincide with the geometric centers.

Furthermore, according to another alternative embodiment of the present invention, the intermediate body comprises a connecting channel having a configuration with "8"-shaped section, that is, two partially overlapped circumferences. Alternatively, said connecting channel section may also be in other forms, such as, for example, squared, rectangular, triangular, oval, star forms, etc. Additionally, it should be clear that in the present invention the outlet channel can be provided with a section with shapes equivalent to the shape of the connecting channel as well as different forms and a space between the connecting channel and the outer surface of the outlet channel must be provided to form a space sufficient for the passage of gases.

Furthermore, according to a particular embodiment of the present invention, said intermediate body is fixed directly to the edges of said hollow body and said cover.

According to a preferred embodiment of the acoustic attenuator device of the present invention, said body, cover and intermediate body are made of low thermal conductivity material. In addition, fixation of the edge of said hollow body to the edge of said cover, pressing and locking said intermediate body, can be effected using welds, glues, adhesives or mechanical locks.

Further, according to an alternative embodiment of the present invention, the acoustic attenuator device comprises an intermediate adapter disposed between the hollow body and the cover to form additional acoustic chambers. According to an advantageous embodiment, the acoustic attenuator device for compressors, in accordance with the present invention, comprises two intermediate bodies respectively disposed and secured between the edges of said hollow body to the intermediate adapter, and between the edge of this adapter to the edge of said cover.

Additionally, in accordance with an advantageous embodiment for production and assembling lines, said intermediate adapter is made by incorporating an intermediate body, thus eliminating a fixing step during the processes and, consequently, an eventual fragility concerning leakage risks is prevented.

As can be appreciated by those skilled in the art, the acoustic attenuator device of the present invention can have its structural elements in vertical or horizontal form, that is, the platforms of the intermediate bodies should be horizontally or vertically disposed.

Furthermore, according to an optional embodiment of the present invention, said cover and the outlet channel are fabricated into one single part or in an independent form, and they can be subsequently connected during the assembling lines of the attenuator devices.

BRIEF DESCRIPTION OF THE DRAWINGS

Features, advantages and technical effects of the present invention, as formerly highlighted, will be better understood by a person skilled in the art by means of the following merely exemplificative detailed and non-limitative description of the preferred embodiments, and with reference to the attached schematic figures, wherein.

DETAILED DESCRIPTION OF THE INVENTION

In accordance with the schematic figures described above, some examples of preferred and possible embodiments of the present invention will be described in detail below. However, it is important to point out that this will be a merely exemplificative and non-limitative description, since the present attenuator device for refrigeration system compressors, in general, can comprise different details and technical structural and dimensional aspects without, however diverting from the scope of protection of the present invention.

Figure 1:
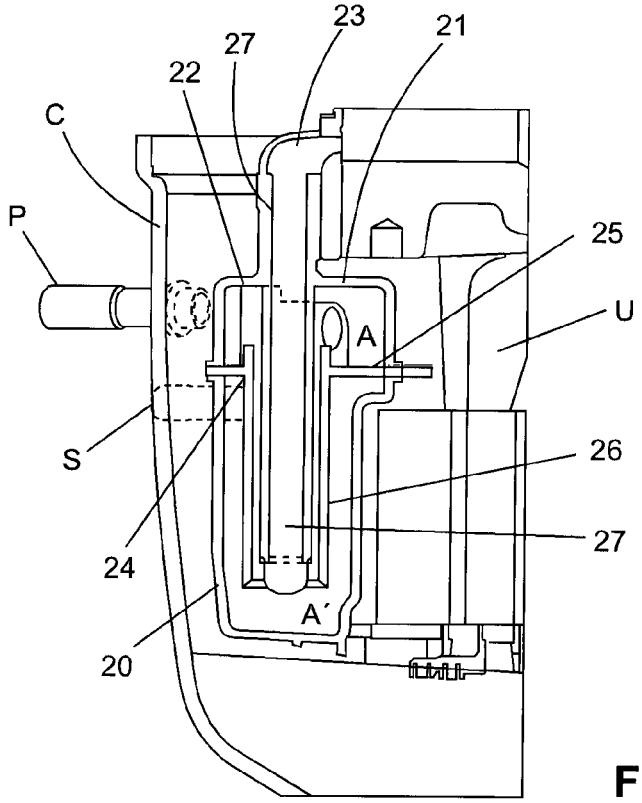
FIG. 1 illustrates a partial cut view of a hermetic compressor containing an attenuator device in accordance with the present invention.
Figure 2:
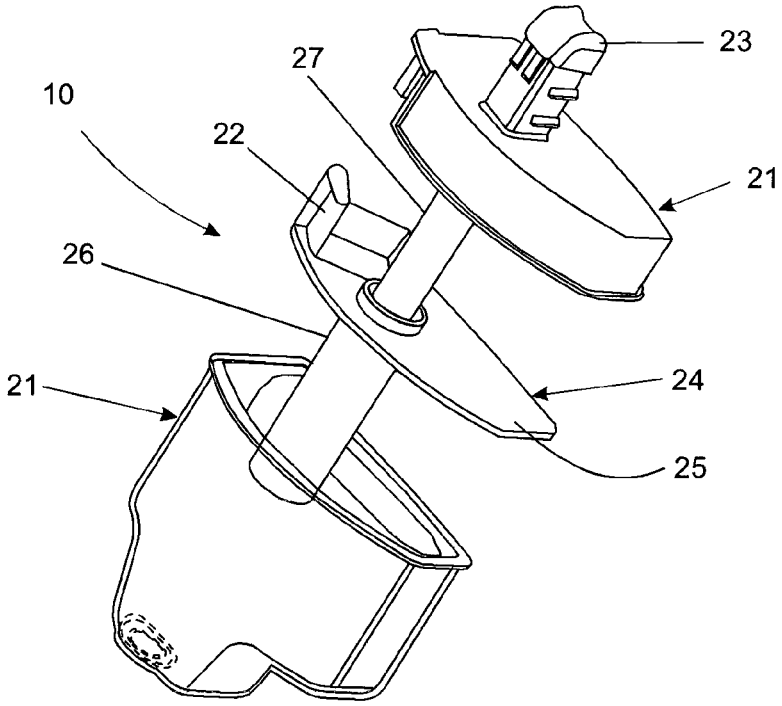
FIG. 2 illustrates a perspective exploded view of the attenuator device of the present invention.
Figure 3:
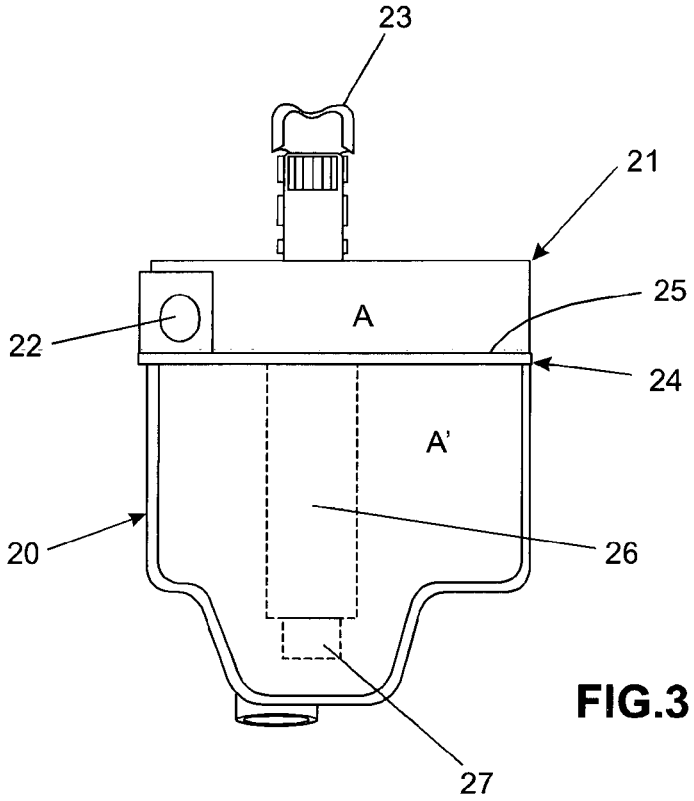
FIG. 3 illustrates a front view of the attenuator device of the present invention.
Figure 4:
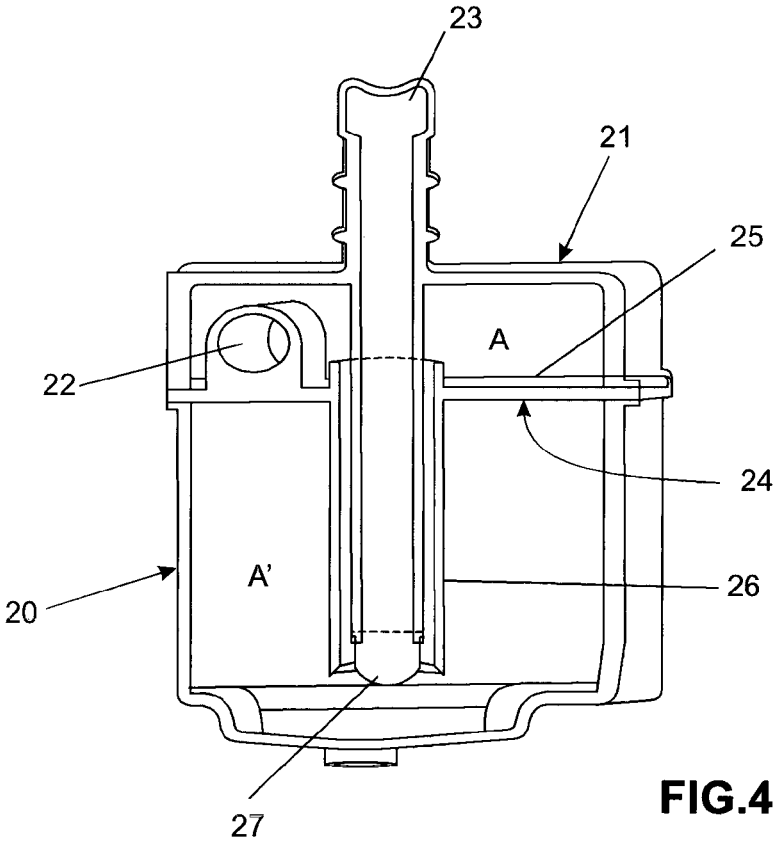
FIG. 4 illustrates a cut view of the attenuator device depicted in FIG. 3.

FIG. 1 shows a partial cut view of a compressor formed of a hermetic housing (C), within which a compression unit (U) is accommodated, which is conventionally equipped with suction and discharge valves to allow for the appropriate refrigeration system operation. Further, as widely known by those skilled in the art, said hermetic housing also comprises at least one strainer (P) connected to at least one refrigeration system suction line and further an outlet (S) for connection with the discharge line of the same suction system.

The attenuator device (10) of the present invention is connected to both suction or discharge lines, in particular still within the hermetic housing (C), and more preferably connected to the compression unit (U). As mentioned above, said attenuator device 10 can be applied either to suction line or to discharge line, varying in accordance with manufacturers' interests and designs.

By way of example only, FIG. 1 shows a configuration in which said attenuator device 10 is installed near the suction valve of the compression unit (U). However, it is should be reiterated that the attenuator device 10 can be easily applied near the discharge valve of said compression unit (U) provided that the technical and structural features as described below are maintained.

In this sense, it is observed that the attenuator device 10 of the present invention comprises a hollow body 20 closed by a cover 21, forming at least a structure provided with at least one inlet hole 22 and one outlet hole 23, wherein an intermediate body 24 is provided between said hollow body 20 and said cover 21 to divide said structure into at least two acoustic chambers (A, A'), and it is formed by a platform 25 containing at least one connecting channel 26 in fluid communication with said acoustic chambers (A, A') and also surrounding the outlet channel 27 that is interconnected with said outlet hole 23 disposed on said cover 21.

In accordance with one of the possible embodiments of the present invention, such as schematically illustrated in FIGS. 1 to 4, gas entering the structure of said attenuator gas 10 through the inlet hole 22 is conducted to the first acoustic chamber (A), which is fully filled with gas that is sequentially conducted to the second acoustic chamber (A') through said connecting channel 26, particularly through the space formed between this connecting channel 26 and the outer surface of the outlet channel 27. Said second acoustic chamber (A') is then filled with gas, and depending on the compression unit pulsation the gas will be conducted through the outlet channel 27 up to the outlet hole 23.

In accordance with the present invention, one may note that the formation of the acoustic chambers as well as the channels through which the gas flow is conducted do not present sealing means by simple interference as well as there is a substantial reduction in the number of elements to structurally form the attenuator device. More specifically, it is observed that risks of gas leakage either inside or to the outside of the attenuator device of the present invention are considerably reduced, mainly because the intermediate body 24 is directly secured to the edges of the hollow body 20 and to the cover 21, also permitting using more effective means of external fixation once they refer to easily accessed regions after the device is assembled as a whole. This is unlike the state-of-the-art devices, whose partitions and channels are disposed and interconnected within the hollow body and need to be secured between one another before the device is effectively mounted.

According to the preferred embodiments of the present invention, components of the attenuator device 10 are made of a low thermal conductivity material to reduce impact on the gas properties and, consequently, on the efficiency of the refrigeration system in general. In addition, fixation of the edge of the hollow body 20 to the edge of said cover 1, by pressing and locking the intermediate body, can be carried out by any known means, such as, for example, welds, glues, adhesives, mechanical locks, etc.

Moreover, it should be clear that the relationship of the positioning between the connecting channel 26 and the outlet channel 27 can preferably be in a concentric form, i.e., aligned with the same geometric center. Alternatively, said relationship between said channels can be off-centered, that is, off the geometric center, provided that a space between the connecting channel 26 and the outer surface of the outlet channel 27 sufficient for gas passage is maintained.

Figure 6:
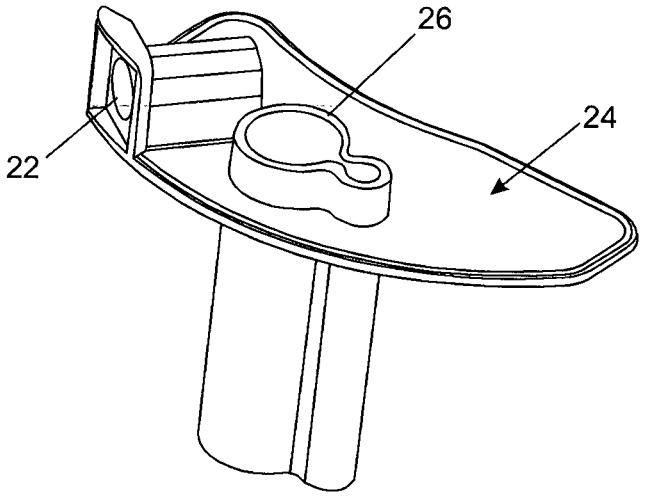
FIG. 6 illustrates a perspective view of an alternative embodiment of the intermediate body of the attenuator device of the present invention.
Figure 7:
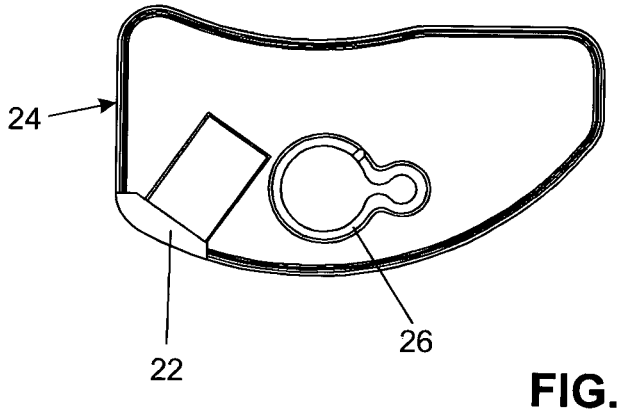
FIG. 7 illustrates an upper view of the intermediate body depicted in FIG. 6.

More particularly, from FIGS. 6 and 7, it is observed that an alternative embodiment of the intermediate body 24 that helps to conduct the gas flow of the first acoustic chamber (A) towards the second acoustic chamber (A'), wherein, in this case, said connecting channel 26 comprises a configuration having a "8"-shaped section, that is, with two partially overlapped circumferences. In this sense, despite the fact that said figures illustrate embodiments in which the connecting channel section is circular or "8"-shaped, alternatively, said section of the connecting channel 26 can also be in other forms, for example, squared, rectangular, triangular, oval, star forms, etc.

Additionally, although not illustrated, it should be clear that the outlet channel 27 can also be in a form equivalent to that of the connecting channel 26 as well as different forms provided that there will exist a space between said connecting channel 26 and the outer surface of the outlet channel 27, as mentioned above.

Figure 5A:
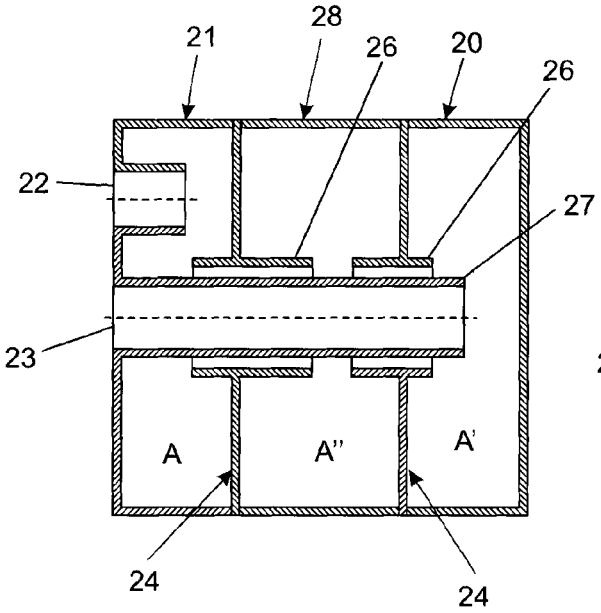
FIGS. 5A, 5B, 5C and 5D illustrate schematic views of alternative embodiments of the attenuator device of the present invention.
Figure 5B:
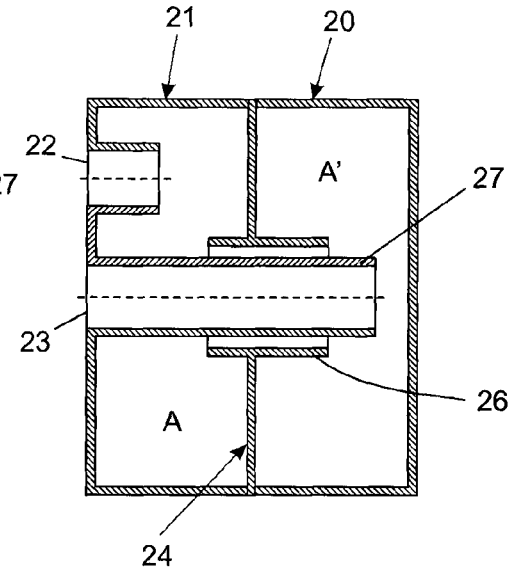

FIGS. 5A to 5D illustrate two alternative embodiments of the attenuator device of the present invention. More particularly, FIGS. 5A and 5B show embodiments containing an inlet hole 22 and an outlet hole 23 which are very similar to those models depicted in FIGS. 1 to 4. With regard to FIGS. 5C and 5D, they show embodiments in which the structure of the attenuator device 10 is provided with two inlet holes 22 and one outlet hole 23, wherein such kind of embodiment is very useful for refrigeration systems equipped with two suction lines, e.g. the hermetic line and the equalized line.

Figure 5C:
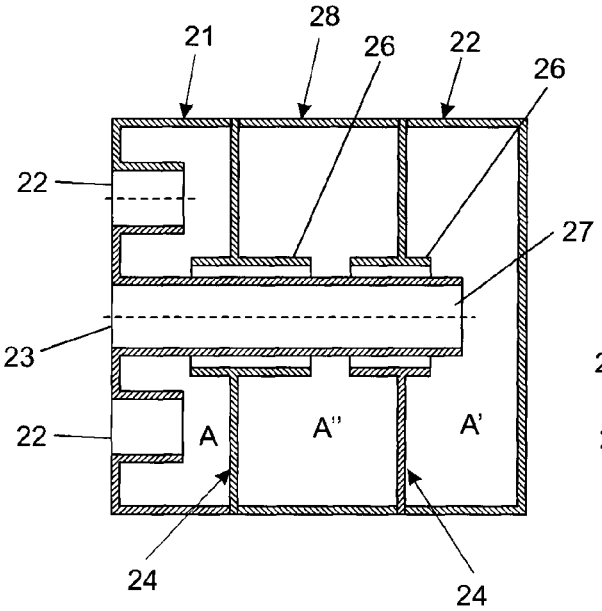
Figure 5D:
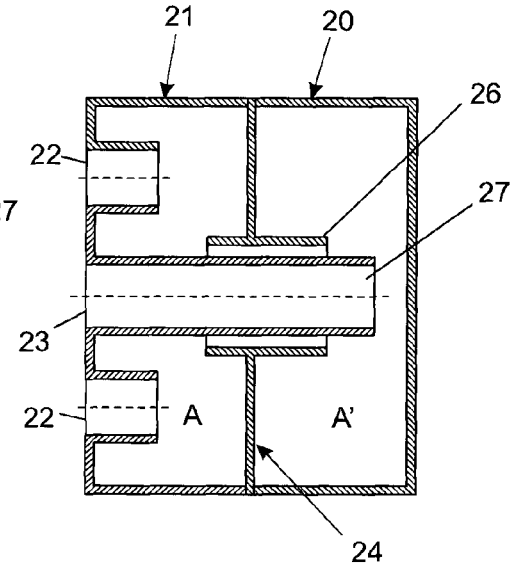

More specifically, with regard to embodiments illustrated in FIGS. 5A and 5C, it is verified that the attenuator device of the present invention comprises three acoustic chambers A, A' and A", wherein the acoustic chamber A" is formed by disposing an intermediate adapter 28 between said hollow body 20 and cover 21. According to these alternative embodiments of the present invention, two intermediate bodies 24, duly positioned and secured between the edges of said body 20 with the intermediate adapter 28, and between the edge of this adapter 28 with the edge of the cover 12 are respectively disclosed.

Additionally, as can be appreciated by a person skilled in the art, said intermediate adapter 28 can be made by introducing one of the intermediate bodies 29, which would facilitate the production and assembling lines of the two attenuator devices 10 in addition to reducing leakage risk since this would eliminate one of the regions of fixation between the parts.

By this way, as can be seen from FIGS. 5A and 5C gases enter the first chamber (A) through inlet orifices 22, said gases being conducted by the first connecting channel 26, thus filling the intermediate acoustic chamber (A"). Sequentially, the gases are conducted through the second connecting channel 26 towards the second acoustic chamber (A') and, subsequently, these gases exit the outlet channel 27 towards the outlet hole 23.

Such as illustrated in the attached figures, it should be emphasized that the structure of the attenuator device 10 can be in a vertical form, as depicted in FIGS. 1 to 4 as well as in a horizontal form, as depicted in FIGS. 5A to 5D. In other words, partitions formed by platforms 25 of the intermediate body 24 can be housed inside the device structure, horizontally or vertically.

In view of these embodiments, it is clear that the attenuator device of the present invention can be designed with a plurality of acoustic chambers, wherein to do so only a combination and disposition of intermediate adapters 28 with the additional intermediate bodies are required provided that the disposition of the outlet channel 27 surrounded by the pluralities of connecting channels 26 formed by each intermediate body is maintained.

Further, said outlet channel 27, according to a possible embodiment of the present invention, can be made in conjunction with said cover 21, that is, said cover 21 and said outlet channel 27 are made into a single part. Alternatively, said components are independently fabricated and subsequently connected during the method of mounting the attenuator device of the present invention.

The invention claimed is:

1. Compressor with an acoustic attenuator device, comprising:

a hollow body closed by a cover, forming a structure provided with at least one inlet hole and one outlet hole, CHARACTERIZED in that there is provided between said hollow body and said cover at least one intermediate body which divides said structure into at least two acoustic chambers, said at least one intermediate body is formed by a platform provided with at least one connecting channel in fluid communication with said acoustic chambers, said at least one connecting channel further surrounds an outlet channel which is interconnected with said outlet hole;

wherein the connecting channel of said intermediate body comprises a configuration which section is "8" shaped; and said connecting channel and said outlet channel are concentrically disposed causing the gases to be conducted to the second acoustic chamber through the space formed between said connecting channel and the outer surface of the outlet channel.

2. Compressor with an acoustic attenuator device, in accordance with claim 1, CHARACTERIZED in that said intermediate chamber is directly secured to the edges of the hollow body and the cover.

3. Compressor with an acoustic attenuator device, in accordance with claim 1, CHARACTERIZED in that it is made of a low thermal conductivity material.

4. Compressor with an acoustic attenuator device, in accordance with claim 1, CHARACTERIZED in that said connecting channel of said intermediate body comprises a configuration which section is circular, squared, rectangular, triangular, oval or in star form.

5. Compressor with an acoustic attenuator device, in accordance with claim 1, CHARACTERIZED in that said outlet channel comprises forms equivalent to that of the connecting channel.

6. Compressor with an acoustic attenuator device, in accordance with claim 1, CHARACTERIZED in that said outlet channel comprises forms different from the shape of said connecting channel.

7. Compressor with an acoustic attenuator device, in accordance with claim 1, CHARACTERIZED in that that the fixation of said hollow body with the edge of said cover, pressing and locking said intermediate body, is carried out by welds, glues, adhesives or mechanical locks.

8. Compressor with an acoustic attenuator device, in accordance with claim 1, CHARACTERIZED in that it comprises at least one intermediate adapter disposed between said hollow body and said cover.

9. Compressor with an acoustic attenuator device, in accordance with claim 8, CHARACTERIZED in that it comprises two intermediate bodies, positioned and fixed between the edges of said hollow body to the intermediate adapter and between the edge of this adapter to the edge of said cover, respectively.

10. Compressor with an acoustic attenuator device, in accordance with claim 8, CHARACTERIZED in that said intermediate adapter is made by incorporating an intermediate body.

11. Compressor with an acoustic attenuator device, in accordance with claim 1, CHARACTERIZED in that its constituting elements are vertically or horizontally structured and said platforms are horizontally or vertically disposed.

12. Compressor with an acoustic attenuator device, in accordance with claim 1, CHARACTERIZED in that said cover and said outlet channel are fabricated into one single part.

13. Compressor with an acoustic attenuator device, in accordance with claim 1, CHARACTERIZED in that said cover and said outlet channel are independently fabricated.

* * * * *